US006179086B1

(12) United States Patent
Bansemir et al.

(10) Patent No.: US 6,179,086 B1
(45) Date of Patent: Jan. 30, 2001

(54) NOISE ATTENUATING SANDWICH COMPOSITE PANEL

(75) Inventors: Horst Bansemir, Munich; Walter Gembler, Ottobrunn; Ottmar Haider, Unterhaching; Christian Ritzer, Munich, all of (DE)

(73) Assignee: Eurocopter Deutschland GmbH, Munich (DE)

( * ) Notice: Under 35 U.S.C. 154(b), the term of this patent shall be extended for 0 days.

(21) Appl. No.: 09/246,652

(22) Filed: Feb. 8, 1999

(30) Foreign Application Priority Data

Feb. 6, 1998 (DE) ..... 198 04 718

(51) Int. Cl.[7] ..... E04B 1/82

(52) U.S. Cl. ..... 181/292; 181/290; 181/285; 181/198

(58) Field of Search ..... 181/292, 290, 181/285, 210, 204, 200, 198

(56) References Cited

U.S. PATENT DOCUMENTS

| | | | | |
|---|---|---|---|---|
| 2,477,852 | | 8/1949 | Bacon . | |
| 3,977,492 | * | 8/1976 | Hankel | 181/33 G |
| 4,155,211 | | 5/1979 | Saylor et al. . | |
| 4,235,303 | * | 11/1980 | Dhoore et al. | 181/214 |
| 4,248,647 | | 2/1981 | Herron et al. . | |
| 4,265,955 | * | 5/1981 | Harp et al. | 428/116 |
| 4,294,329 | | 10/1981 | Rose et al. . | |
| 4,298,090 | * | 11/1981 | Chapman | 181/286 |
| 4,317,503 | | 3/1982 | Söderquist et al. . | |
| 4,421,455 | * | 12/1983 | Tomren | 415/119 |
| 4,560,028 | | 12/1985 | Perret . | |
| 4,671,841 | * | 6/1987 | Stephens | 156/292 |
| 5,058,705 | | 10/1991 | Rheinländer . | |
| 5,414,232 | * | 5/1995 | Wilson | 181/292 |
| 5,543,198 | * | 8/1996 | Wilson | 428/116 |
| 5,604,010 | | 2/1997 | Hartz et al. . | |

FOREIGN PATENT DOCUMENTS

| | | |
|---|---|---|
| 2112393 | 10/1971 | (DE) . |
| 2515127 | 10/1975 | (DE) . |
| 3025617 | 2/1981 | (DE) . |
| 3643480 | 7/1988 | (DE) . |
| 9408118 U1 | 10/1995 | (DE) . |

OTHER PUBLICATIONS

Publication Agard Conference Proceedings 549; "Impact of Acoustic Loads on Aircraft Structures" (Sep. 1994) in an article by G. Niesl et al., entitled "Helicopter Internal Noise".

* cited by examiner

*Primary Examiner*—Robert E. Nappi
*Assistant Examiner*—Edgardo San Martin
(74) *Attorney, Agent, or Firm*—W. F. Fasse; W. G. Fasse

(57) ABSTRACT

A sandwich composite panel (2) provides a load bearing structural member as well as noise protection, especially for a helicopter fuselage cell or cabin. The panel (2) includes an inner honey-comb core (6) made up of hollow cell bodies (4) extending trans-versely and sandwiched between first and second cover skins (8, 10) of fiber composite material. In order to achieve a low weight, a simple manufacturing, and good noise absorption, at least one of the cover skins (8) adapted to face the main source of noise (H) is made up of an open mesh fiber composite net (12) and a flexible cover film (16) applied on the outer surface of this fiber composite net (12). The net (12) has a smaller mesh size than the inner cross-sectional size of the hollow cell bodies (4).

20 Claims, 2 Drawing Sheets

NOISE ATTENUATING SANDWICH COMPOSITE PANEL

PRIORITY CLAIM

This application is based on and claims the priority under 35 U.S.C. §119 of German Patent Application 198 04 718.5, filed on Feb. 6, 1998, the entire disclosure of which is incorporated herein by reference.

FIELD OF THE INVENTION

The invention relates to a sandwich composite panel, especially for the fuselage or cabin shell of a helicopter, including a hollow cell core sandwiched between two fiber composite cover skins. The sandwich composite panel has a noise attenuating characteristic.

BACKGROUND INFORMATION

It has been a longstanding problem in the design and construction of helicopters, that the rotor drive train and auxiliary devices as well as the main rotor and the tail rotor generate a substantial noise load in the interior of the cabin of the helicopter. In order to reduce this noise loading, it has become known to cover or panel the interior walls of the helicopter cabin with noise damping panels or liners. However, the use of such noise damping panels or the like entails a very substantial effort and expense in terms of the installation and construction thereof, and also causes a substantial weight penalty in the helicopter. This is especially true if the noise damping elements are to be effective over the various noise frequency ranges of noise generated by the various above mentioned helicopter noise sources.

Another approach to noise attenuation is known from the publication "AGARD CONFERENCE PROCEEDINGS 549" "Impact of Acoustic Loads on Aircraft Structures" (September 1994) in an article by G. Niesl et al., entitled "Helicopter Internal noise ", which describes a helicopter wall structure having a sandwich construction type with an integrated noise insulation. In the known sandwich structure, the fiber composite cover layer that is arranged facing toward the source of noise is provided with a plurality of through-going holes that lead to the individual honeycomb cells of the sandwich core. By providing such holes through the noise-loaded cover layer, the honeycomb cells are thereby embodied to act as noise absorbing cavities in a discrete frequency range in the manner of a Helmholtz-resonator.

However, such a known construction suffers disadvantages, for example each individual through-going hole causes fiber breaks or interruptions in the fiber composite material of the cover skin. As a result, the specific strength of the sandwich structure relative to the surface or area weight thereof, becomes significantly reduced compared to a comparable sandwich structure without such through-going holes, especially if the density of holes is relatively large. Moreover, boring the individual holes through the cover layer requires an increased effort and expense in fabricating the composite structural panel. Furthermore, the open holes provide an undesirable access path for various environmental influences, such as moisture and dust deposits and the like, to penetrate into the interior of the sandwich structure, which increases the weight of the structure, reduces the noise absorbing performance over time, and leads to the accelerated degradation of the structure.

SUMMARY OF THE INVENTION

In view of the above, it is an object of the invention to provide a sandwich composite panel of the above described general type that achieves an effective noise protection characteristic in combination with a low weight and a low manufacturing effort and expense, in comparison to the prior art. It is a further object of the invention to provide such a composite panel that achieves noise damping or noise absorption over a broad noise frequency band including several sub-ranges. The invention further aims to avoid or overcome the disadvantages of the prior art, and to achieve additional advantages, as apparent from the present specification.

The above objects have been achieved in a sandwich composite panel according to the invention, including first and second fiber composite cover skins and a hollow cell core made up of hollow cell bodies extending transversely, or especially substantially perpendicularly, between the two cover skins. Further according to the invention, especially for achieving noise absorption, at least one of the cover skins of the panel, and particularly the cover skin that is to be arranged facing toward the main noise source, comprises an open mesh fiber composite net, and a flexible cover film covering the open mesh net. The open mesh net has a smaller mesh size than the internal crosssectional size of the hollow cell bodies of the panel core, whereby there are preferably a plurality of mesh openings of the net arranged over and opening into the hollow cell chamber of each cell body of the core while the fibers remain continuous and uninterrupted. For reasons of cost reduction, the cover skins preferably comprise a glass fiber composite material, which may be a solid composite layer or an open mesh composite net as described above.

The inventive embodiment of the composite panel cover skin as a fiber composite net covered by a flexible cover film, in combination with the inner core of the composite panel formed of hollow cell bodies, achieves a highly effective noise absorption in the sandwich composite panel by means of a plurality of individual resonators respectively formed by the hollow cell bodies of the inner core of the panel. Moreover, the area density or surface area weight of the finished panel, relative to the necessary strength and stiffness of the panel, as well as the manufacturing effort and expense for fabricating the sandwich composite panel are held to a minimum. This is achieved especially through the use of the fiber composite net in at least one of the cover skins, because such a net has a low weight or density, and because such a fiber composite net can be easily produced having the required mesh size, for example by a wrapping or winding method, so as to provide the necessary acoustic access openings into the interior of the hollow cell bodies with a minimum of manufacturing effort, e.g. avoiding the need for boring individual holes through a cover skin. In this manner, the inventive composite panel completely meets the requirements pertaining especially in the field of helicopter construction, namely a lightweight construction, with excellent noise protection characteristics and a high load strength.

In order to provide the most effective shielding against narrow band frequency ranges, it has been proved to be especially effective and advantageous to use a closed or solid cover film as the covering over the fiber composite mesh net of the cover skin. In this manner it is possible to achieve a high degree of noise absorption, e.g. at least 95% and nearly up to 100%, while simultaneously achieving the additional advantage that the solid or closed film prevents the penetration of dust and moisture into the hollow cells of the sandwich composite core. On the other hand, a broad band absorption characteristic of the sandwich composite panel is achieved by using a perforated or porous film as the cover film of the cover skin. Any known porous or perforated film can be used, as long as it is durable under the expected operating conditions of the panel, e.g. with regard to temperature, moisture, etc.

As a simple manner of integrating different noise resonators having different noise absorption characteristics into the sandwich composite panel, an embodiment of the invention provides that the hollow cell bodies have different hollow cell heights in a direction substantially perpendicular to the cover skins of the panel. This can be achieved simply by providing cell closing end walls at different heights in different cells, or by the provision of a separating wall as will be described below.

In order to achieve a further reduction in the weight, while simultaneously embodying the sandwich composite panel in such a manner that it is noise absorbing for noises incident both from the interior side as well as from the exterior side, the panel may be constructed with both the inner and outer cover skins comprising the above described arrangement of an open mesh fiber composite net covered with a flexible cover film. In this context, an especially effective noise absorption with respect to noise incident from both sides is preferably achieved in that a closed or solid separating wall extends through the inner core of the panel between the two cover skins. In this way, the inner core is separated into two core parts, because the separating wall extends substantially in the surfacial extension direction of the cover skins. Throughout this specification, the terms "closed" and "solid" refer to a layer that does not have pores or perforations extending through a thickness thereof, but may have closed-cell pores or a hollow core enclosed therein.

In a particularly preferred detailed embodiment, this separating wall extends at an acute angle relative to the two cover skins, whereby the above mentioned two core parts have wedge-shaped configurations resulting in the above mentioned different hollow cell heights. This is an especially simple manufacturing technique for providing these hollow cells having different heights for respectively achieving different noise absorption characteristics. Alternatively, the separating wall may extend through the inner core substantially parallel to the cover skins to achieve the two-part separation of the inner core, without providing different hollow core heights.

In another alternative embodiment, only a first one of the cover skins comprises a fiber composite net with a cover film thereon, while the second one of the cover skins is embodied as a closed or solid fiber composite cover layer. Such a construction is particularly suitable in applications in which the surface or cover skin of the composite panel facing away from the noise source, e.g. the interior of the helicopter cabin, must comprise a flat or smooth surface or must be strengthened on this side. While such a construction necessarily entails an increase in weight, it also achieves an increased noise absorption effectiveness of the overall sandwich composite panel.

In addition to the noise absorption provided in the individual hollow chamber resonators of the cellular core, the inventive sandwich composite panel can additionally provide a noise damping on the side of the sandwich panel facing away from the main noise source. Such a feature is especially recommended for reducing the noise level in the interior of helicopter cabins, for example. To achieve this, the cover skin of the composite panel facing away from the main noise source is provided with an additional noise damping layer. If this cover skin comprises a closed or solid fiber composite cover layer, then the noise damping layer preferably comprises a foam material layer arranged between the fiber composite cover layer and the inner core structure. On the other hand, it is especially preferred for reasons of weight reduction, to embody also the second cover skin as a fiber composite net and provide a noise damping film as a noise damping layer applied onto this fiber composite net of the second cover skin.

The inventive sandwich composite panel may be used simply as an inner wall paneling or as a non-load bearing intermediate wall in combination with other load bearing wall elements, for example in the construction of an aircraft fuselage. More importantly however, the inventive sandwich composite panel itself can be used and installed as an integral component of a load bearing or carrying structure, and particularly a helicopter fuselage cell. The sandwich composite panel is especially well suited for such applications due to its high structural strength and low weight.

BRIEF DESCRIPTION OF THE DRAWINGS

In order that the invention may be clearly understood, it will now be described in connection with several example embodiments, with reference to the drawings, wherein.

DETAILED DESCRIPTION OF PREFERRED EXAMPLE EMBODIMENTS AND OF THE BEST MODE OF THE INVENTION

Figure 1:
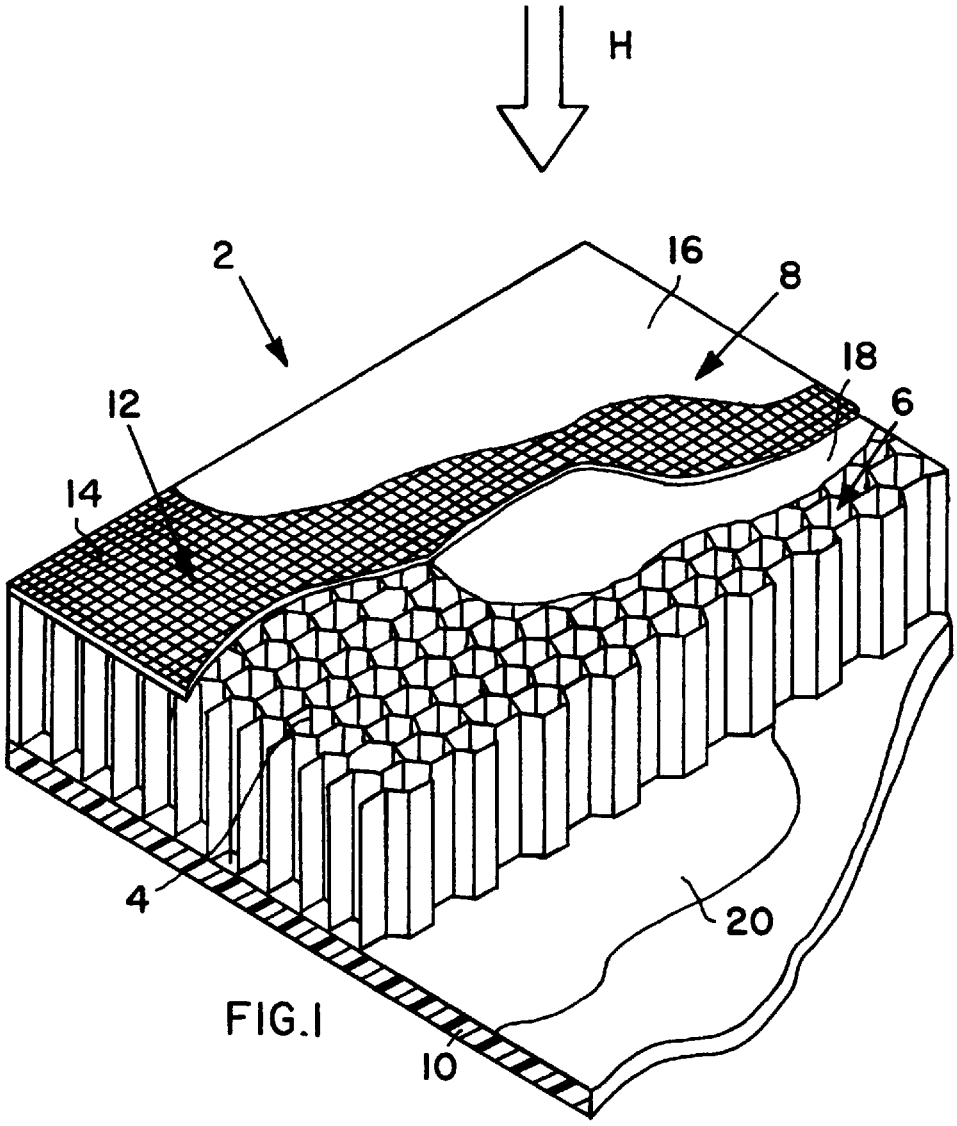
FIG. 1 is a partially cut-away schematic perspective view of a first embodiment of a sandwich composite panel according to the invention.

As shown in FIG. 1, a first embodiment of a sandwich composite panel 2 according to the invention comprises a low density inner core 6 sandwiched between two outer fiber composite cover skins 8 and 10. The core 6 is particularly in the form of a honeycomb core 6 formed of upright standing hollow cell bodies 4, that extend transversely between the two cover skins 8 and 10. The core 6 can be any known type of hollow cell core, whereby the hollow cell bodies 4 may be any known tubular cell bodies, for example resin impregnated paper or cardboard cells, resin impregnated extruded fiber composite tubes, extruded metal tubes such as aluminum tubes, or a structure of stamp-formed resin impregnated fiber composite sheets or stamp-formed metal sheets. The cell bodies 4 may have hexagonal, round, quadrilateral, octagonal or varying cross-sectional shapes.

In this embodiment, the cover skins 8 and 10 are each fabricated of a glass fiber composite material including glass fibers bonded together, for example with any suitable synthetic resin binder. The second cover skin 10 in this embodiment comprises a continuous closed or solid fiber composite layer. On the other hand, the first or upper cover skin 8, which is adapted to face toward the direction of incidence of a main noise source H, comprises an open mesh fiber composite net 12, and a flexible thin cover film 16 covering the outer side of the fiber composite net 12. This cover film 16 may, for example, be a film obtained under the name "Kapton" that is available in ordinary commercial trade. The fiber composite net 12 is a mesh or net of individual fibers or fiber bundles or rovings 14 that cross each other and are respectively oriented at different angles depending on the load strength and any directional strength characteristics required for the particular application. In the illustrated embodiment of FIG. 1, the fibers or fiber bundles 14 cross each other at 90° angles, but any required oblique angle is possible as well.

The net 12 may be formed with the fiber bundles or fibers 14 woven or knitted to each other, or may simply be pressed to each other and held together by the resin binder of the composite net 12. This fiber composite net 12 may be fabricated in any known manner, for example by well known winding processes. The mesh size of the fiber composite net 12, i.e. the pitch spacing of adjacent ones of the fibers 14, can be manufactured as necessary for any particular application, but is substantially smaller than the inner cross-sectional dimension of the hollow cell bodies 4 of the honeycomb core 6. Thus, the fiber composite net 12 will provide a plurality of mesh openings into the open end of each hollow cell body 4, and a plurality of fibers 14 crossing the open end of each hollow cell body 4.

The two cover skins 8 and 10 are sandwiched and bonded onto the honeycomb core 6 by means of respective interposed adhesive films 18 and 20. During the lamination and adhesive bonding of the fiber composite net 12 onto the honeycomb core 6 by the adhesive film 18, the excess adhesive material of the film 18 is sucked away through the mesh openings of the net 12 so as to remove the excess adhesive. This reduces the surface area weight of the finished sandwich composite panel 2 and especially also prevents excess adhesive residues from closing or blocking the mesh openings of the fiber composite net 12.

The above described construction forms respective hollow chamber resonators respectively of the individual hollow cell bodies 4 of the honeycomb core 6, which are covered on the side facing the direction of incidence of the main noise source H by the fiber composite net 12 and the cover film 16 arranged on the net 12, and which are closed on the back side by the fiber composite layer 10. These hollow chamber resonators have an excellent noise absorption response, which may be tuned or influenced as necessary for any particular application by appropriately selecting the hollow chamber size of the hollow cell bodies 4, the mesh opening size of the net 12, and the material, density, thickness, and other characteristics of the cover film 16 used in the particular case. For example, by using a closed or solid cover film 16, a narrow band noise absorption characteristic with an absorption coefficient of nearly 100% can be achieved. On the other hand, by using a cover film 16 that has fine holes or pores, or microperforations provided therein, it is possible to achieve a noise absorption over a considerably broader band of noise frequencies, while being less strongly defined for high absorption in a particular narrow resonance range.

Figure 2:
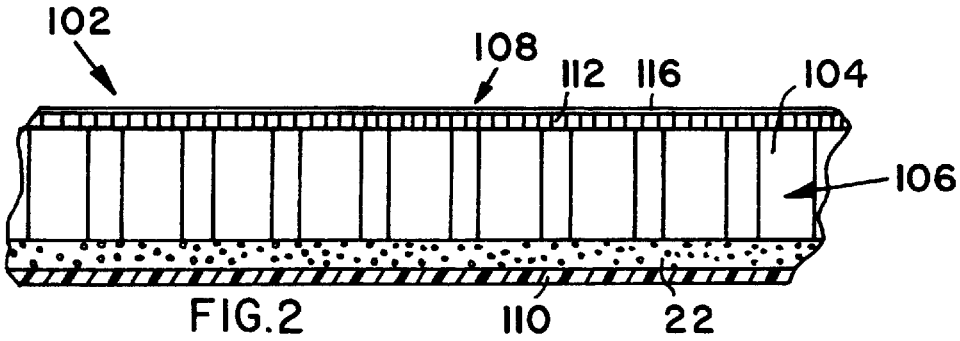
FIG. 2 is a schematic cross-section through a second embodiment of a composite panel according to the invention, including a damping layer arranged between the second cover skin and the inner core.

FIG. 2 shows a second embodiment of a sandwich composite panel according to the invention, whereby the components or elements corresponding to those of the first embodiment shown in FIG. 1 are labelled by a reference number that is respectively increased by 100 relative to the reference numbers of FIG. 1. Thus, a sandwich composite panel 102 comprises an inner core 106 sandwiched between a closed or solid fiber composite second cover skin 110 and a first cover skin 108 including a fiber composite net 112 and a cover film 116.

As a distinction relative to the composite panel 2 of FIG. 1, the present composite panel 102 further includes a noise damping layer 22 comprising a foam material arranged between the solid fiber composite second cover skin 110 and the inner core 106. This noise damping layer 22 in such an arrangement serves to improve the overall broad band noise reduction achieved by the sandwich composite panel 102, and thus improves the overall noise protective effect. Except for this damping layer 22, the rest of the structure, construction, and function of the sandwich composite panel 102 is the same as that of the panel 2 discussed above in the first example embodiment in connection with FIG. 1.

Figure 3:
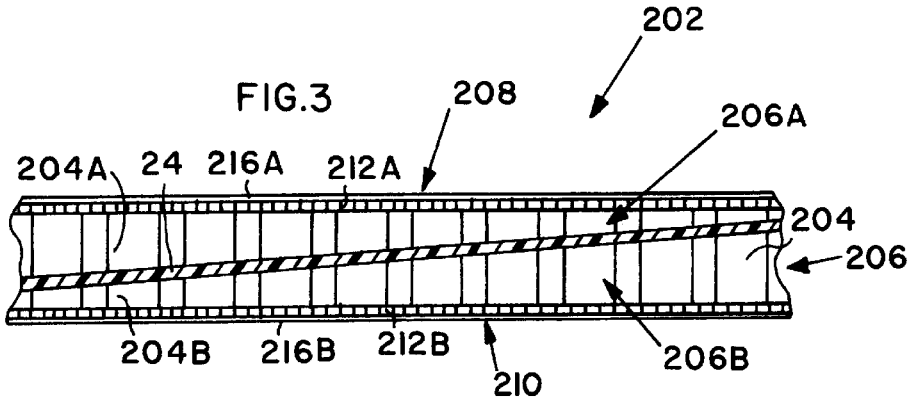
FIG. 3 is a schematic cross-section through a third embodiment of a composite panel according to the invention including a separating wall between the cover skins to separate the inner core into two inner core portions.

FIG. 3 shows a third embodiment of the invention, wherein respective components of the sandwich composite panel 202 are labelled with reference numbers that have been increased by 200 relative to the corresponding components of the first embodiment shown in FIG. 1. In the present embodiment of FIG. 3, the sandwich composite panel 202 comprises two cover skins 208 and 210 sandwiched onto an inner core 206. In this embodiment, in contrast to the above described embodiments, both of the cover skins 208 and 210 comprise a respective fiber composite net 212A and 212B covered on the outer side by a respective flexible cover film 216A and 216B. With this arrangement, the sandwich composite panel 202 is uniformly or equally noise absorbing with respect to noise incident from both sides of the panel 202, i.e. noise incident onto both cover skins 208 and 210, assuming that the nets 212A and 212B have the same mesh size, fiber material, area density, etc., but it is alternatively possible to tailor the noise absorption differently on the two opposite sides by providing different mesh sizes, fiber materials, area densities, etc. for the nets 212A and 212B.

As a further distinguishing characteristic, the inner core 206 of the present third embodiment is divided into two core portions 206A and 206B by a separating wall 24 that runs at an angle between the cover skins 208 and 210. While the small broken sectional view of FIG. 3 shows the separating wall 24 extending only with a single planar slope direction, it should be understood that the separating wall 24 can extend in zig-zag fashion sloping repetitively back and forth between the two cover skins 208 and 210.

The separating wall 24, which may be a solid fiber composite layer, separates the respective hollow cell bodies 204 into upper and lower cell bodies 204A and 204B. Due to the angled or sloping arrangement of the separating wall 24, the upper cell bodies 204A respectively and the lower cell bodies 204B respectively have varying hollow chamber heights over the area of the panel. Namely, the hollow cell bodies 204A respectively have varying chamber heights between the first cover skin 208 and the separating wall 24, while the hollow cell bodies 204B have respective different or varying hollow chamber heights between the second cover skin 210 and the separating wall 24. Also, at any particular location or path through the composite panel 202, the corresponding aligned hollow cell body 204A and hollow cell body 204B on opposite sides of the separating wall 24 will have different chamber heights, except at the particular location at which the separating wall 24 passes through the center of the thickness between the two cover skins 208 and 210. Due to these different hollow chamber heights, the individual resonators formed thereby have different absorption characteristics with different noise absorption maxima in respective frequency ranges that are substantially uniformly distributed over a broad frequency band.

Aside from the above discussed distinctions, the remaining structure, construction, and function of the sandwich composite panel 202 corresponds to that described above in connection with the first and second embodiments. It is simply necessary to cut or otherwise prepare wedge-shaped core bodies 206A and 206B so that the separating wall 24 can be adhesively laminated and sandwiched therebetween during the assembly and fabrication process.

Figure 4:
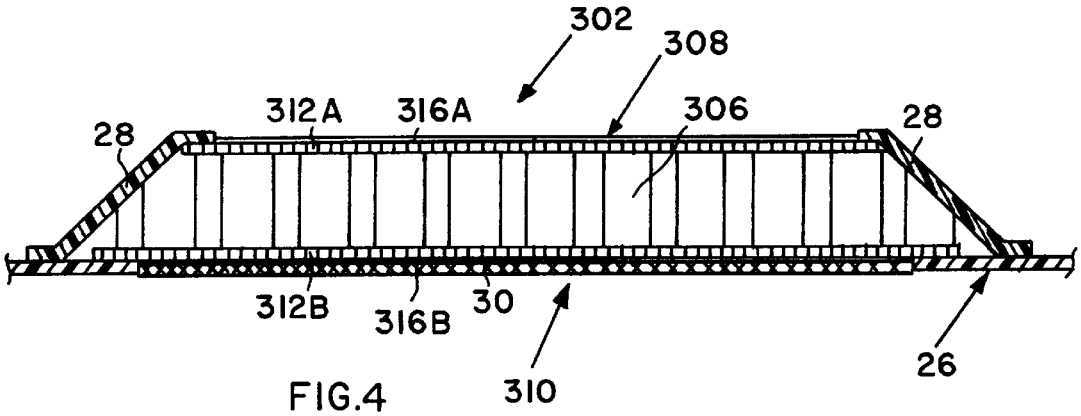
FIG. 4 is a schematic cross-section through a fourth especially preferred embodiment of a sandwich composite panel according to the invention that is covered on one side with a damping film and that is incorporated into a load bearing structure.

FIG. 4 illustrates a fourth embodiment in which the individual components corresponding to those discussed above have reference numbers increased by 300 relative to those used in FIG. 1. This embodiment is an especially preferred arrangement in which the composite panel 302 is an integral component of a load bearing structure 26 such as a helicopter fuselage cell or support frame. The panel 302 again comprises an inner honeycomb core 306 sandwiched between two cover skins 308 and 310, which are each respectively formed of an open mesh fiber composite net 312A and 312B covered by a respective cover film 316A and 316B. In view of the loads that will be introduced into and effective on the composite panel 302, this panel is particularly embodied as a high strength, high stiffness, lightweight composite structural panel. A secure load bearing connection of the panel 302 with the rest of the load bearing structure 26 (e.g. comprising metal or fiber composite structural members) is achieved by means of fiber composite header or doubler members 28 that form a load bearing frame around the composite panel 302.

The installed orientation of the sandwich composite panel 302 is selected so that the upper cover skin 308 is oriented toward the main noise source, for example the noise producing helicopter (assemblies such as the main rotor transmission and drive arrangement. The lower cover skin 310 that faces the cabin interior has an additional noise damping film 30 applied onto the outer cover film 316B in order to further improve the noise protection provided for the occupants of the helicopter cabin. Except for the above described distinctions, the structure, construction, and function of the sandwich composite panel 302 shown in FIG. 4 is the same as those of the above described embodiments.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A sandwich composite panel comprising:

a first cover skin comprising a first open-mesh fiber composite net having a first mesh size, and a first flexible cover film laminated onto said first open-mesh fiber composite net;

a second cover skin comprising a second open-mesh fiber composite net having a second mesh size that is different from said first mesh size, and a second flexible cover film laminated onto said second open-mesh fiber composite net; and an inner core sandwiched between said first and second cover skins, wherein said inner core comprises a plurality of hollow cell bodies that respectively extend transversely between said first and second cover skins and respectively have internal cross-sectional dimensions greater than said first mesh size and greater than said second mesh size.

2. The sandwich composite panel according to claim 1, wherein said cell bodies are honeycomb cell bodies, and said inner core is a honeycomb core.

3. The sandwich composite panel according to claim 1, wherein said first cover skin is adapted to be oriented to face toward a main source of noise for the purpose of absorbing said noise in said hollow cell bodies respectively forming resonator cavities.

4. The sandwich composite panel according to claim 3, wherein said first flexible cover film is a closed solid film that completely covers and seals said first open-mesh fiber composite net, such that said panel including said resonator cavities is characterized by a narrow band noise absorption characteristic with a high absorption coefficient.

5. The sandwich composite panel according to claim 3, wherein said first flexible cover film has openings therethrough into said hollow cell bodies, such that said panel including said resonator cavities is characterized by a broad band noise absorption characteristic.

6. The sandwich composite panel according to claim 1, wherein said first flexible cover film is at least one of a porous film and a perforated film.

7. The sandwich composite panel according to claim 1, wherein said first flexible cover film is a closed solid film.

8. The sandwich composite panel according to claim 1, wherein said hollow cell bodies have hollow chambers therein with different respective hollow chamber heights in a direction extending transversely between said cover skins.

9. The sandwich composite panel according to claim 1, further comprising a closed solid separating wall extending through said inner core generally in an area extension direction of said panel between said first and second cover skins, wherein said inner core is separated by said separating wall into a first core portion between said separating wall and said first cover skin and a second core portion between said separating wall and said second cover skin.

10. The sandwich composite panel according to claim 9, wherein said separating wall extends at an acute angle relative to said first and second cover skins, and wherein each of said core portions comprises at least one wedge configuration.

11. The sandwich composite panel according to claim 10, wherein said separating wall has a zig-zag configuration extending repetitively at said acute angle back and forth between said first and second cover skins.

12. The sandwich composite panel according to claim 1, further comprising a noise damping film laminated onto said second cover skin.

13. The sandwich composite panel according to claim 1, further comprising a noise damping layer arranged generally on a side of said panel away from said first cover skin.

14. The sandwich composite panel according to claim 13, wherein said noise damping layer comprises a foam material layer interposed between said second cover skin and said inner core.

15. The sandwich composite panel according to claim 1, further comprising a noise damping layer of a foam material interposed between said second cover skin and said inner core.

16. The sandwich composite panel according to claim 1, wherein said second open-mesh fiber composite net of said second cover skin and said first open-mesh fiber composite net of said first cover skin respectively comprise a composite including glass fibers.

17. A sandwich composite panel comprising:

a first cover skin comprising a first open-mesh fiber composite net having a first mesh size, and a first flexible cover film laminated onto said first open-mesh fiber composite net;

a second cover skin comprising a fiber composite material; and an inner core sandwiched between said first and second cover skins, wherein said inner core comprises a plurality of hollow cell bodies that respectively extend transversely between said first and second cover skins and respectively have internal cross-sectional dimensions greater than said first mesh size;

wherein said first open-mesh fiber composite net comprises continuous uninterrupted fibers defining mesh openings therebetween, with a respective plurality of said mesh openings opening into each respective one of said hollow cell bodies; and further comprising a remainder of an adhesive film between said inner core and said first open-mesh fiber composite net with film openings through said film coinciding with said mesh openings, said remainder of said adhesive film having a configuration as is formed by arranging a continuous solid adhesive film between said inner core and said first open-mesh fiber composite net and then sucking an excess of said solid adhesive film through said mesh openings so as to form said film openings through said film.

18. The sandwich composite panel in accordance with claim 1, further in combination with and integrally incorporated with a load bearing structure of a helicopter.

19. The sandwich composite panel according to claim 17, wherein said fiber composite material of said second cover skin comprises a second open-mesh fiber composite net, said second cover skin further comprises a second flexible cover film laminated onto said second open-mesh fiber composite net, and said second open-mesh fiber composite net has a second mesh size equal to said first mesh size.

20. The sandwich composite panel according to claim 17, wherein said second cover skin comprises a closed solid layer of said fiber composite material.

* * * * *